United States Patent [19]

Brown

[11] 4,192,703

[45] Mar. 11, 1980

[54] UNIVERSAL LABELING APPARATUS

[75] Inventor: Frank E. Brown, Hacienda Heights, Calif.

[73] Assignee: Avery International Corporation, San Marino, Calif.

[21] Appl. No.: 921,957

[22] Filed: Jul. 5, 1978

[51] Int. Cl.[2] ..... B65C 3/12

[52] U.S. Cl. ..... 156/443; 156/446; 156/542

[58] Field of Search ..... 156/443, 446–450, 156/455, 458, 566–567, 558–559, 584, DIG. 8–DIG. 13, 540–542

[56] References Cited

U.S. PATENT DOCUMENTS

| | | | |
|---|---|---|---|
| 2,920,780 | 1/1960 | Hauschild et al. | 156/542 X |
| 3,779,829 | 12/1973 | Wolff | 156/DIG. 12 X |
| 3,806,395 | 4/1974 | French | 156/542 X |
| 3,841,946 | 10/1974 | Carter | 156/566 |
| 4,124,429 | 11/1978 | Crankshaw | 156/542 X |

OTHER PUBLICATIONS

"Avery Labeling Machinery", Bulletin of Avery International Company, Brochures of Models 2004, 4101, 5101, 5209, 6101, 6204–6201, 6304, 6404, 6504, 6604, 6705, 6809, 7105, No dates.

*Primary Examiner*—David A. Simmons

*Attorney, Agent, or Firm*—Poms, Smith, Lande & Rose

[57] ABSTRACT

A universal labeling system is provided to perform all of the basic package labeling functions, including applying labels (1) to the side of packages or bottles, (2) to the top, (3) to three sides of a rectangular or similar product, (4) to two opposite sides of a product, and (5) wrapping the labels completely around a round product, such as a bottle. The machine accommodates bottles and packages of many different sizes. Structurally, the universal labeling apparatus includes standardized mechanical power supply arrangements and a heavy duty standardized base having a cross-sectional configuration corresponding to an inverted "T", with the central raised portion carrying a conveyor belt and the two lower side portions of the base carrying longitudinally and laterally adjustable mounts for one or more label applicator heads. At least two standard applicator heads may be used simultaneously, and other equipment which may be provided includes a wrap-around belt, a powered hold-down belt, and an alternative powered top roller. Also, feed screws may be located at desired points along the conveyor belt to bring the product to be labeled up to the conveyor belt speed. The powered top roller has the same diameter and is arranged to be mounted from the same fixture as the top hold-down belt. The drives for the feed screws in the two alternate positions of the feed screws are identical. With the foregoing and other arrangements, a single apparatus may perform a wide variety of labeling functions on a wide variety of types and sizes of packages and bottles.

27 Claims, 20 Drawing Figures

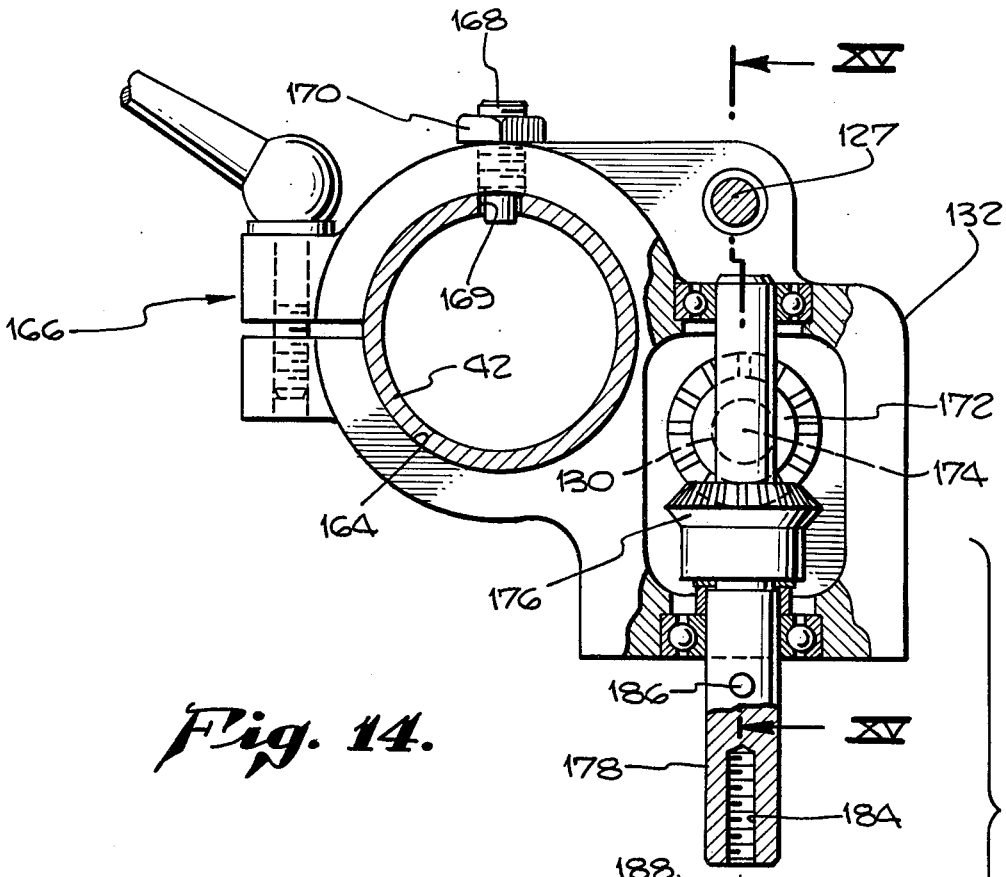
Fig. 14.
Fig. 15.
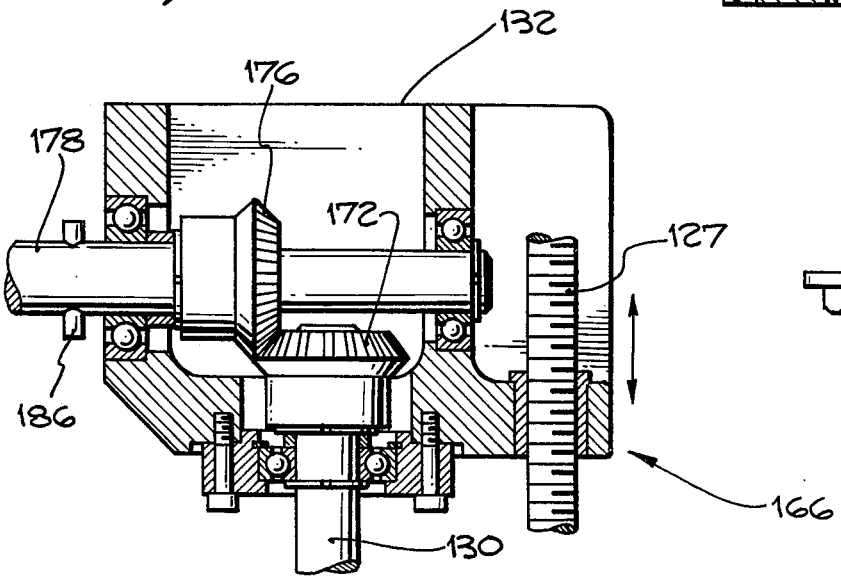

UNIVERSAL LABELING APPARATUS

FIELD OF THE INVENTION

The present invention relates to automatic labeling systems.

BACKGROUND OF THE INVENTION

Many different special purpose labeling apparatus have previously been constructed. For example, and as described in the catalog of machines available from Avery International, Inc., the assignee of the present invention, labeling machines have been provided for applying labels to both the front and the back of packages or bottles, and the same machine may also be provided with a labeling applicator for applying labels to the top of products being labeled. Other machine configurations are employed for two and three panel wrap applications; and yet another type of machine is used for wrapping labels around a circular product or container.

Such high speed, special purpose apparatus have been entirely satisfactory for many customers; however, many companies have need for a versatile high-speed labeling machine which is capable of performing many different labeling functions, and which can be rapidly and effectively switched over from one mode of operation to another, using a minimum of additional equipment.

Accordingly, a principal object of the present invention is to provide a labeling system which will satisfy this demand.

SUMMARY OF THE INVENTION

In accordance with the present invention, a single standardized heavy duty base and standardized mechanical power supplying arrangements are provided for accomplishing a wide variety of important labeling applications, including specifically:

(1) Side Labeling.
(2) Top Labeling.
(3) Three Panel Labeling.
(4) Front and Back Labeling.
(5) Wrap-around Labeling of a Round Bottle or Other Round Product.

In addition, the universal machine provides power for driving the conveyor belt at a variable speed, power take-off points for (1) the conveyor drive, (2) a feed screw drive on one side of the conveyor belt, (3) a feed screw drive on the other side of the conveyor belt, (4) a drive for the wrap-around belt which may be located on one side of the conveyor belt and (5) a drive for either a powered top roller or a top hold-down belt which will be above the conveyor. These power take-off points are provided with openings through the heavy gauge base (cabinet) or through the heavy central deck plate of the standardized universal machine, so that the user may selectively conduct any or all of the five labeling applications listed above, with no re-design or significant machining of the apparatus required.

As a collateral feature, some of the equipment is interchangeable to provide increased flexibility with minimal additional cost. Thus for example, the feed screw drive for an input feed screw located at the input end on one side of the conveyor belt may alternatively be located on the other side and toward the center of the conveyor to feed products to a wrap belt. In addition, the powered top roller and the top hold-down belt are dimensioned and arranged so that they may be driven from the same upwardly extending support bracket and power transmission system so that both will have a surface velocity in engaging the product which is identical with the conveyor speed.

In accordance with a subordinate feature of the invention, the conveyor is provided with an external gear reducer and shaft drive arrangement connected to a takeoff point on the universal base to readily permit extensions in the length of the conveyor belt which is employed.

In accordance with another collateral feature of the invention, a quick change gear box is provided to vary the speed of the two feed screw power take-off points, so that the pitch of the products may be easily changed to accommodate smaller as well as larger products while still maintaining high labeling efficiencies.

To summarize the advantages of the present universal system, heretofore it was customary to make individual custom tailored applicator systems for each labeling job, and the resulting machine was normally made of angle iron and lightweight sheet metal for ease in fabrication; and the specialized mechanical power arrangements were custom tailored for each of the five types of labeling applications enumerated above, or occasionally custom tailored to include more than one of them. In accordance with an important aspect of the present invention, a single stardardized heavy weight, good-looking cabinet is provided with heavy exterior walls for example, of 12-gauge steel. In addition to the cabinet, the standard base may also include a heavy central deck plate, of standard configuration. A standardized power system is provided, with some of the available power take-off points not used because of the particular application under consideration. However, by providing all of the power take-off points readily available to perform each of the different widely used labeling applications, the cost for each universal machine is substantially reduced; and from the customer's standpoint, he always knows that if he needs to perform a different labeling job, his existing universal machine may be readily shifted over to perform the new labeling application.

Other objects, features, and advantages of the invention will become apparent from a consideration of the following detailed description, and from the accompanying drawings.

BRIEF DESCRIPTION OF THE DRAWINGS

FIGS. 14 and 15 show the drive mechanism for the top roller or the hold-down belt;

DETAILED DESCRIPTION

Figure 1:
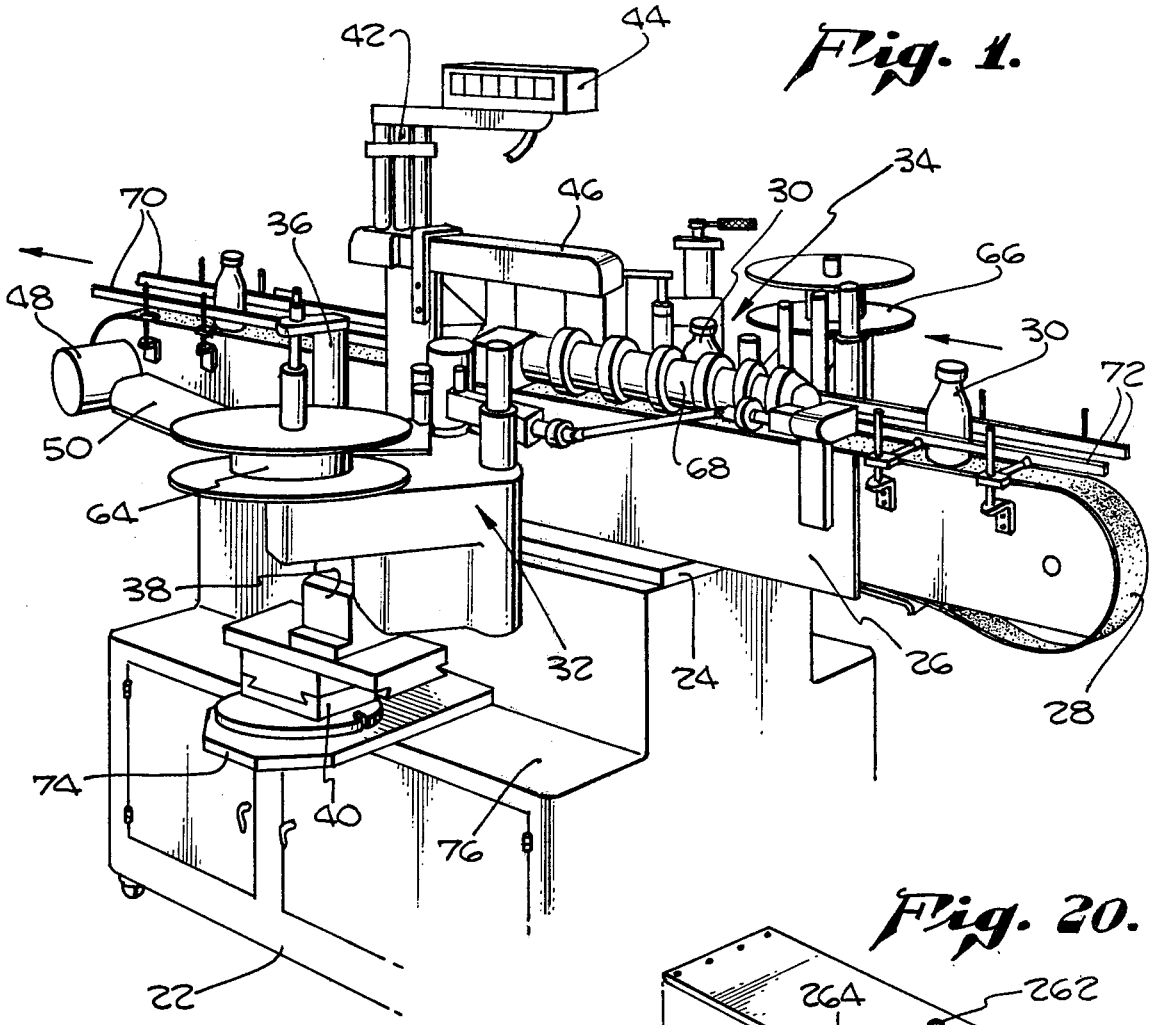
FIG. 1 is a view of a universal labeling machine illustrating the principles of the invention as used in a front and back labeling application.

Referring more particularly to the drawings, FIG. 1 shows a universal labeling machine employed to apply labels to the front and back of bottles. In FIG. 1 a heavy cabinet 22 is provided. This heavy base or cabinet has an inverted "T"-shaped cross-sectional configuration, and is made of heavy gauge steel nearly ⅛" thick. Included as part of the standard base for the universal machine is a heavy ¾ inch thick aluminum "deck" plate 24 mounted on the central raised portion of the cabinet. A conveyor assembly 26 is mounted on the deck plate 24. The conveyor belt 28 is moving from right to left as shown in FIG. 1, and is carrying the bottles 30 in this direction for labeling by two labeling heads, one of which is clearly shown at 32 in the foreground of FIG. 1. A similar head 34 is mounted on the other side of the conveyor 26. These automatic label applicator heads 32 and 34 may be the standard Model No. 500 head produced by the assignee of the present invention. These standard labeling heads are available from the Avery Label Systems Division of Avery International, Inc., 777 East Foothill Boulevard, Azusa, Calif. 91702.

To provide flexibility in positioning the applicator heads 32 and 34, they are adjustably mounted. More particularly, it may be noted that the head 32 is mounted on a 2¾ inch diameter polished supporting column 36, and this column 36 is in turn mounted on a heavy base 38. Between the upper base 38 and the lower base 40 are oppositely directed ways providing movement both toward and away from the conveyor assembly and also parallel to its direction of movement.

A second vertical support column 42 is mounted on the heavy deck plate 24. The column 42 supports the hold-down belt assembly 46 which will be described in greater detail below.

The conveyor belt 28 is driven through the external gear reducer 48 and a drive shaft rod mounted within a protective shield 50. The conveyor drive shaft with a power take-off point at the top of the upper portion of the base, will be described in greater detail below. The use of an external drive shaft facilitates the manufacture of standard cabinet and power take-off units as represented by the assembly 22, 24, and also facilitates the substitution of a longer conveyor belt assembly, when this is requested by a customer.

Figure 2:
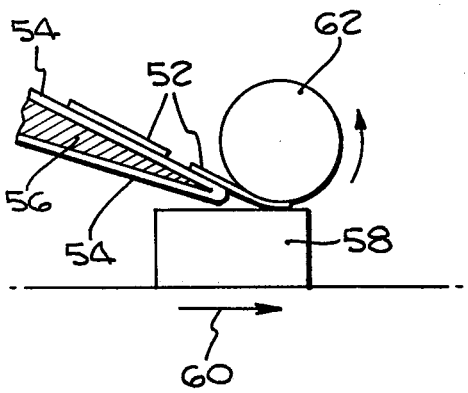
FIG. 2 is a diagrammatic showing of the application of a self-adhesive label from a peeler blade.

Incidentally, FIG. 2 is included for the convenience of persons who may not be familiar with the high speed label applicator field. In FIG. 2 a series of labels 52 which are initially secured to a roll of backing paper 54 are run over a "peeling" blade 56 and the labels are dispensed in synchronism with the arrival of the product 58 which is being moved past the peeling blade 56 by a conveyor belt 60. The labels are provided with self-adhesive material on the side which engages the product, and they are firmly fixed to the product by the pressure roller 62.

Now, returning to FIG. 1, the two applicators 32 and 34 apply labels in the manner shown in FIG. 2 to both sides of the bottles 30 somewhat to the left of the center of the conveyor belt, as shown in FIG. 1. The reels for rolls of labels and backing paper are shown at 64 and 66 for applicators 32 and 34, respectively.

In FIG. 1 a variable pitch screws 68 is shown above the conveyor belt assembly. This screw 68 is variable in its pitch in order to pick up the stationary bottles which are stored at the right-hand end of the conveyor 28 and feed them forward at the normal speed of conveyor belt 28 as they reach the applicators 32 and 34, which have their peeling blades immediately adjacent the bottles as they move along the conveyor belt 28. Depending on the shape of the product to be labelled, either a single feed screw or dual synchronized feed screws may be used, in accordance with accepted practice in the industry.

The hold-down belt assembly 46, together with the retaining guide rails 70 seen above the surface of the conveyor belt at the left-hand end of FIG. 1, serve to give stability to the bottles while they are being labelled, and to prevent them from falling off the conveyor belt as it moves them to the far left end of the conveyor. Similar input guide rails 72 are located at the right-hand end of conveyor belt 28, as shown in FIG. 1.

The standard bases or cabinets and deck plates as shown in FIG. 1 may be employed for nearly all labeling applications, as discussed above, and therefore can be made in larger quantities. Accordingly, standardized fabrication techniques and dies may be employed in their production, instead of the angle iron and lightweight sheet metal fabrication techniques which were previously employed. More specifically, the cabinet or base 22 is now made of 12 gauge sheet steel, which is nearly ⅛ inch thick. The base 40 for adjustably mounting the applicator head 32, is in turn mounted on the ¾ inch thick aluminum plate 74. This is bolted directly onto the flat stepped surface 76 of the heavy steel standardized base 22.

Figures 3, 4, 5, 9:
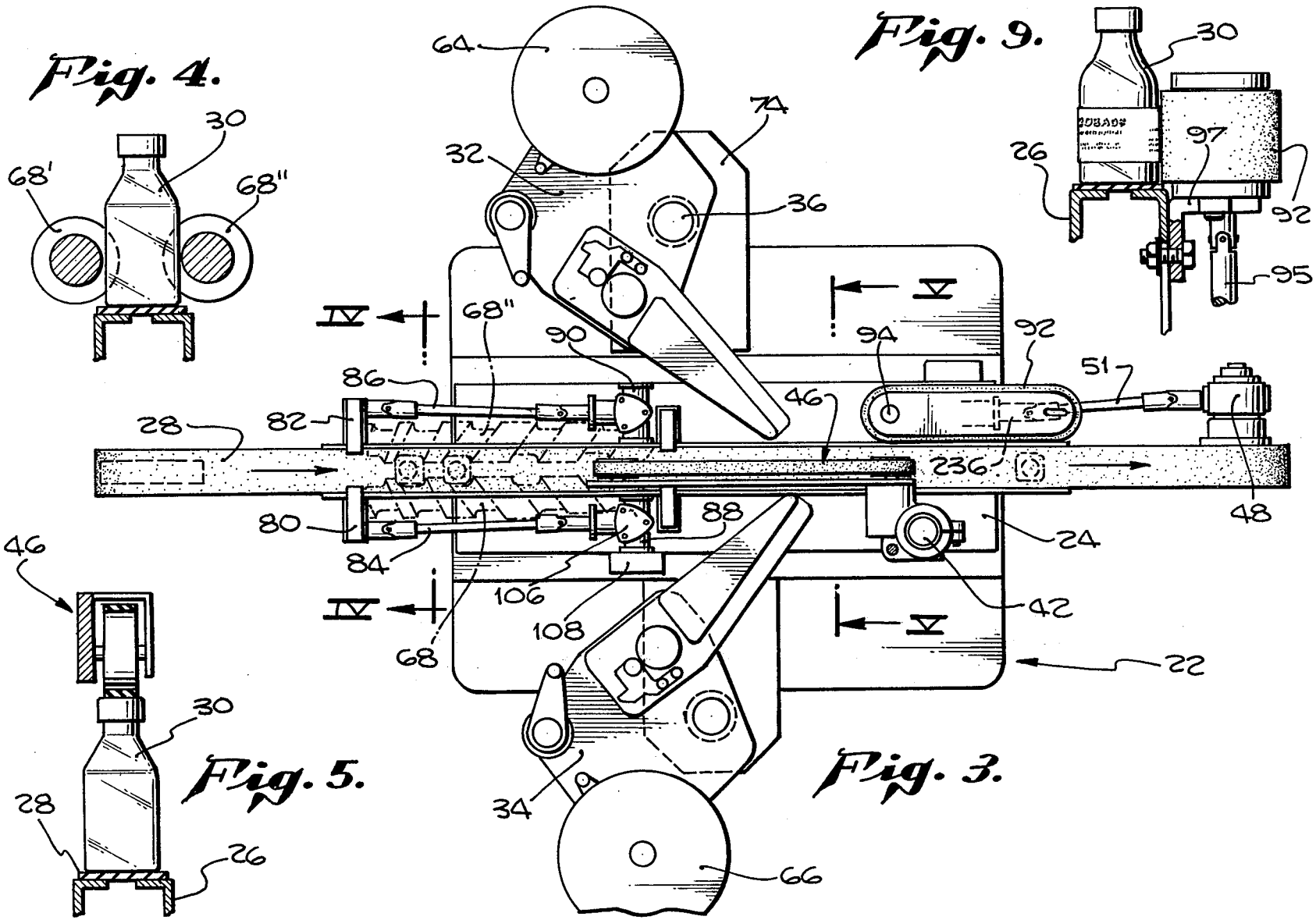
FIG. 3 is a top plan view of the universal machine showing both front and back labeling applicators, a pair of feed screws for feeding product located near the input end of the conveyor belt, a hold-down belt and a wrap belt.
FIG. 4 is a cross-sectional view taken along lines IV—IV of FIG. 3 and showing a pair of feed screws bringing bottles to be labelled up to conveyor speed.
FIG. 5 shows a hold-down belt securely holding the bottle on a conveyor belt.
FIG. 9 on sheet 2 of the drawings shows a view of the wrap belt firmly securing a label to a round product.

FIG. 3 is a top plan view of the universal labeling machine and shows many of the features of the machine, some of which are not clearly shown in FIG. 1. With regard to FIG. 3, it may be noted that the conveyor belt 28 moves from left to right instead of the opposite direction as shown in FIG. 1. It may therefore be useful to recognize that the view of FIG. 1 would have been taken from the upper left-hand corner of FIG. 3. Accordingly, the applicator assembly 32 is at the top and the applicator assembly 34 is at the bottom, as shown in FIG. 3.

Many of the other components of the universal machine, shown in FIG. 1, are also shown in FIG. 3, and these include the base 22, the support plate 74 for the universal head 32, the vertical support column 36 extending between the support plate 74 and its associated base and the head 32, the supporting column 42 which is mounted on the plate 24, the gear reducer drive 48 and its associated drive shaft 51 (protective cover removed), and the reels 64 and 66 associated with the applicator heads 32 and 34, respectively.

A pair of feed screws shown at 68' and 68'' in FIG. 4 (shown in dashed lines in FIG. 3) serve to pick up the containers from storage at the left-hand end of conveyor belt 28, and bring them up to the conveyor speed before they reach the hold-down belt assembly 46 and the applicators 32 and 34. The screws 68' and 68'' are powered through the gear boxes 80 and 82, which are in turn driven by the universal drive shafts 84 and 86, respectively, which are in turn powered from the transmission units 88 and 90, respectively, which are supplied by a quick change gear box forming part of the universal drive system.

Incidentally, the standard pitch for products moving along the conveyor belt 28 is 4 inches. Through the use of the quick change gear box to be discussed below, and a higher pitch set of feed screws corresponding to feed screw 68' and 68'', with the speed of rotation of the feed screws increased, the pitch of the products may be drcreased, to more efficiently apply labels to small size products. The Type 500 head is photocell actuated, to only apply labels when products are actually present in front of the peeling blade; accordingly, the change in pitch of the product normally requires no special changing of the label feeding arrangements of the applicator heads.

The universal machine as shown in FIG. 3 is also provided with a "wrap-around" or wrap belt 92. This belt is normally employed with round products and is present in the system shown in FIG. 3, but is not used when front and back labeling is being undertaken. This wrap-around belt 92 will be described in greater detail in connection with FIGS. 7, 8 and 9 of the drawings. It is noted in passing that the power application point, or power take-off point for the wrap belt is located at 94. When the wrap belt is not part of the assembly, the standard universal unit is still provided with an opening for the drive shaft at point 94 to extend through the heavy central deck plate of the universal unit; however, it is capped off with a standard easily removable circular cap to prevent the entry of dirt into the machine, for example, and to permit ready removal and installation of a wrap belt if the customer should later decide that he wishes to undertake some wrap labeling applications.

FIG. 5 shows the hold-down belt assembly which is often used to hold a product during labelling, when it is not being held by guide rails or by one or two feed screws. The belt engaging the top of the bottle 30 is powered to have the same surface speed as the conveyor 28.

Figures 6, 7, 8:
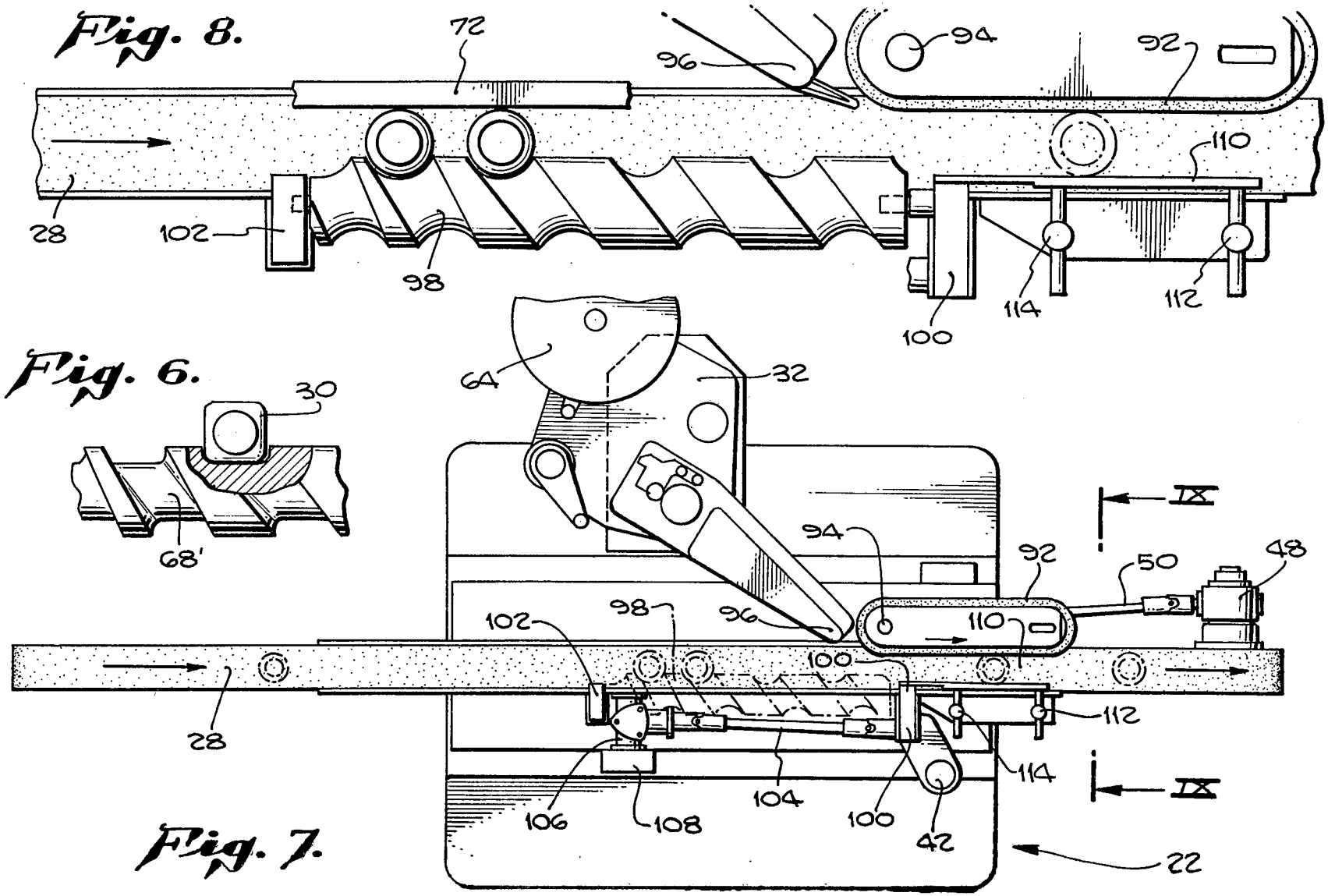
FIG. 6 shows a single feed screw bring a product to be labeled up to conveyor speed.
FIG. 7 is a top plan view showing a single applicator head and associated wrap belt used to wrap labels around a round object such as a bottle.
FIG. 8 is an enlarged view of a key portion of the label application system of FIG. 7.

FIG. 6 is a top view of one of the feedscrews 68'. With a well-defined rectangular product as shown in FIG. 6 one feed screw is normally adequate. With bottles of oval cross-section, however, two feed screws are preferred.

FIG. 7 shows a universal base 22 provided with a single applicator head 32 supplying the labels to be applied to a circular bottle or other container by the wrap belt 92. It may be noted that, for wrap-around applications, the peeling blade is located close to the wrap belt 92 rather than in the position shown in FIG. 3. It may also be noted as shown to advantage in FIG. 8 that the feed screw arrangements for circular products are somewhat different than for the "front-back" labelling system of FIG. 3. More specifically, only one feed screw 98 is employed, and it is located as shown in FIGS. 7 and 8 between the drive unit 100 and the support 102 for the other end of the feed screw 98. Power is supplied to rotate the feed screw 98 through the universal drive shaft 104 which is powered from the drive unit 106. Drive unit 106 is powered by a chain drive extending upwardly from the base 22 and which is protected by the shield 108.

Incidentally, the drive unit 106, as shown in FIGS. 7 and 8, is identical with the drive unit 90 shown on the opposite side of the conveyor belt 28 in the showing of FIG. 3. In addition, the configuration of the feed screw drive unit 82 is the same as screw drive unit 100 as shown in FIGS. 7 and 8, and the drive shaft assemblies 86 of FIGS. 3 and 104 of FIG. 7 are also identical. This interchangeability enhances the universality of the applicator machine disclosed in the present specification, and contributes to economy and flexibility of usage of the apparatus.

Opposite the wrap belt 92 are the adjustable guide rails 110, which may be held in position suitable for the diameter of the products being labelled, by the adjustable screws 112 and 114. It is noted again that the wrap belt 92 is resilient and rotates in the direction indicated by the arrow at approximately twice the speed of the conveyor. Accordingly, the label which is applied at point 96 to the circular product is wrapped around the product which rotates against the guide rails 110 and is firmly applied and secured to the product by the pressure of the outer surface of the wrap belt 92. An end view of the wrap belt 92 and a bottle 30 is shown in FIG. 9 on sheet 2 of the drawings.

Incidentally, in the top plan views which appear in the present drawings, the drive for the conveyor 48 through the drive shaft 50 extends under the wrap belt 92 but is not directly coupled to the wrap belt drive. The wrap belt is driven at point 94 by a shaft 95 extending through the deck plate 24.

Figure 11:
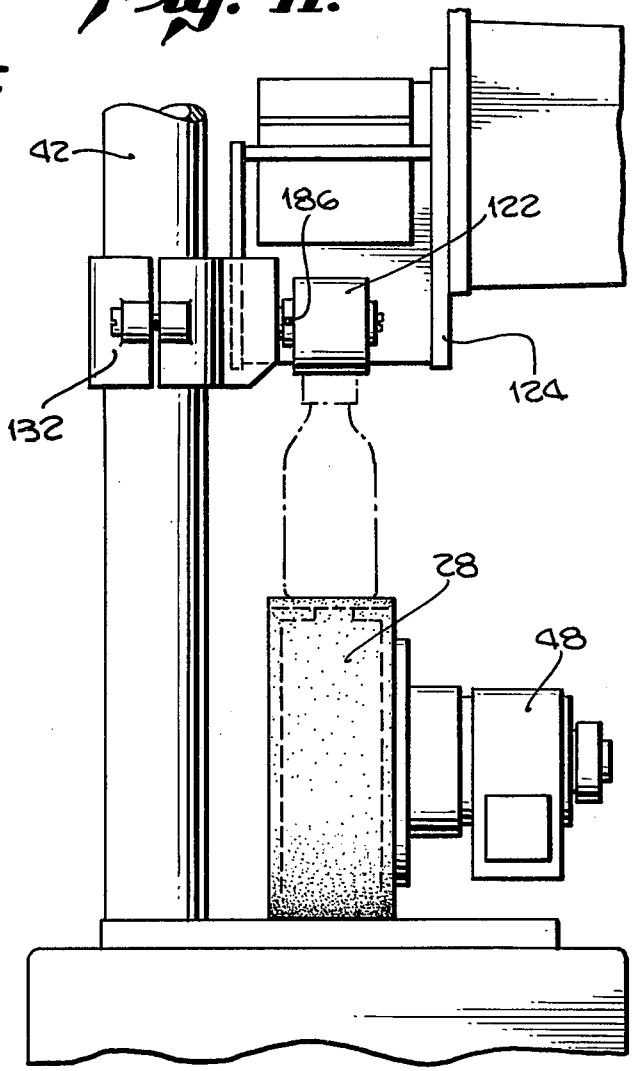
FIGS. 10 and 11 show top and side views, respectively, of an applicator mounted to apply labels to the top of a product, in combination with a powered top roller.
Figure 10:
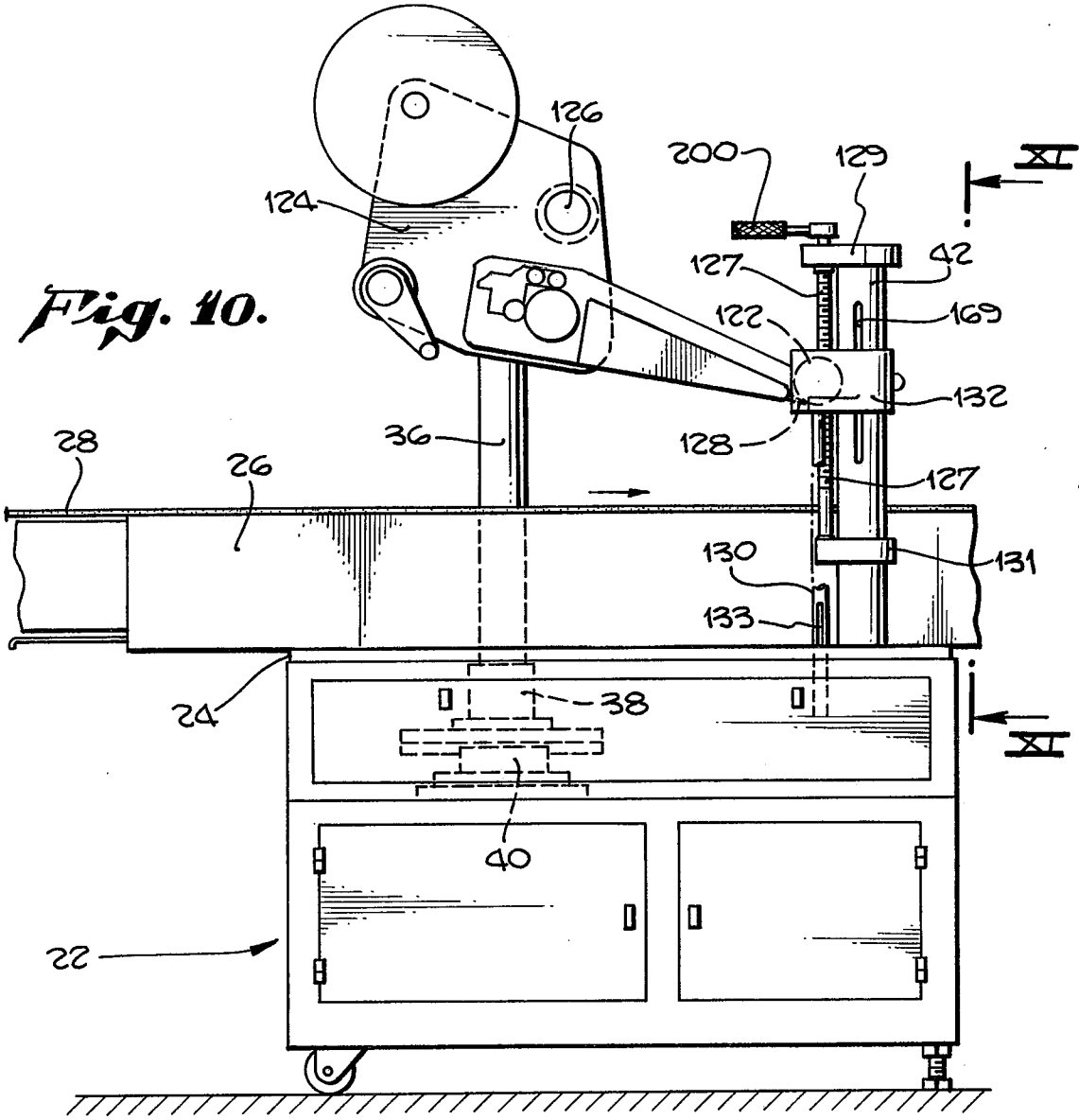

Turning now to FIGS. 10 and 11, these figures show a top label applicator system with a powered top roller 122. In FIG. 10 the conveyor belt 28 moves from left to right, and the products are labelled by the standard applicator head unit 124 which is mounted on a transversely extending column 126 which is in turn supported on the vertical column 36, shown in some of the earlier figures of the drawings. The peeling blade 128 of the applicator head 124 is located immediately adjacent the powered roller 122. Accordingly, as products moving down the conveyor belt 128 trip the photocells which control the operation of the head 124, a label is dispensed over the peeling blade 128 and is firmly applied to the top of the product by the powered roller 122 which is provided with a resilient outer surface. Of course, suitable feed screws for bringing the input products up to this speed of the conveyor belt, and suitable guide rails for holding the product on the conveyor belt are provided, but these are not shown in order to simplify the drawing presentation. As will be developed below, the powered top roller is mounted on the same support which may be used for the hold-down belt and is driven at the same speed. Accordingly, the universality of the entire machine is enhanced, and the need for additional and different equipment is minimized.

The vertically extending shaft 130 provides power to the drive assembly 132. The lower portion of shaft 130 is slotted to provide positive driving from a keyed cylindrical opening in a drive gear unit which is mounted within the cabinet 22. This arrangement permits the vertical adjustment of the drive assembly 132, by the rotation of handle 200 which rotates a threaded shaft 127 extending between brackets 129 and 131, and which extends through a tapped hole in the drive unit 132. With the drive and support unit 132 loosened in its relationship with the vertical support column 42, the powered roller or the hold-down belt may be adjusted to the desired height to accommodate different products.

Figure 13:
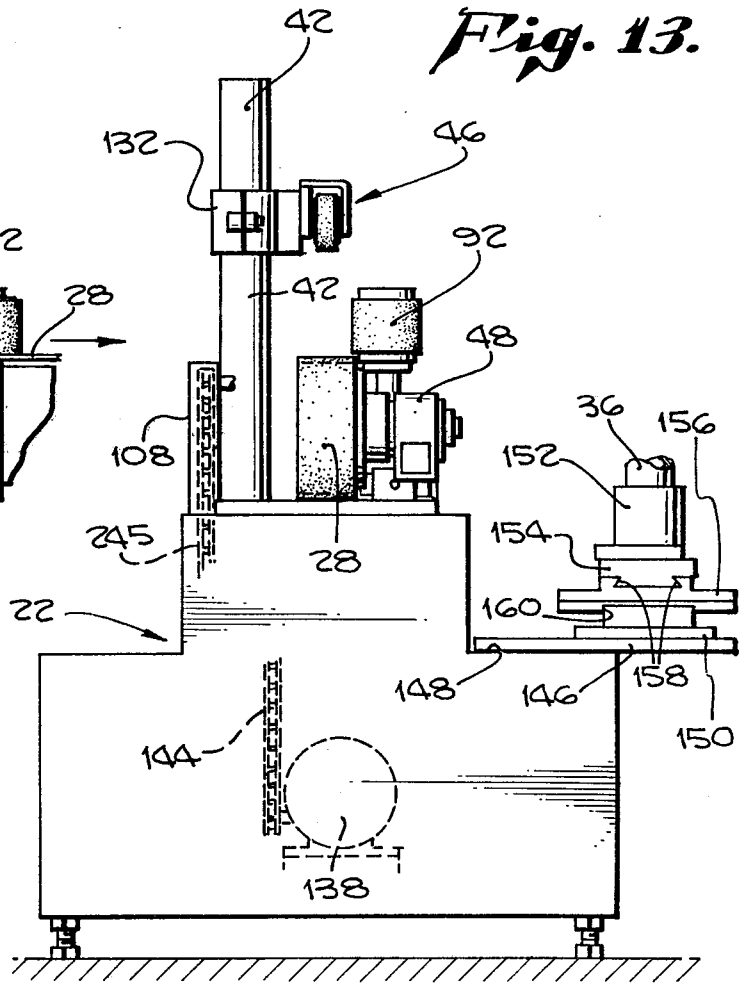
FIG. 13 is an end view of the apparatus of FIG. 6.
Figure 12:
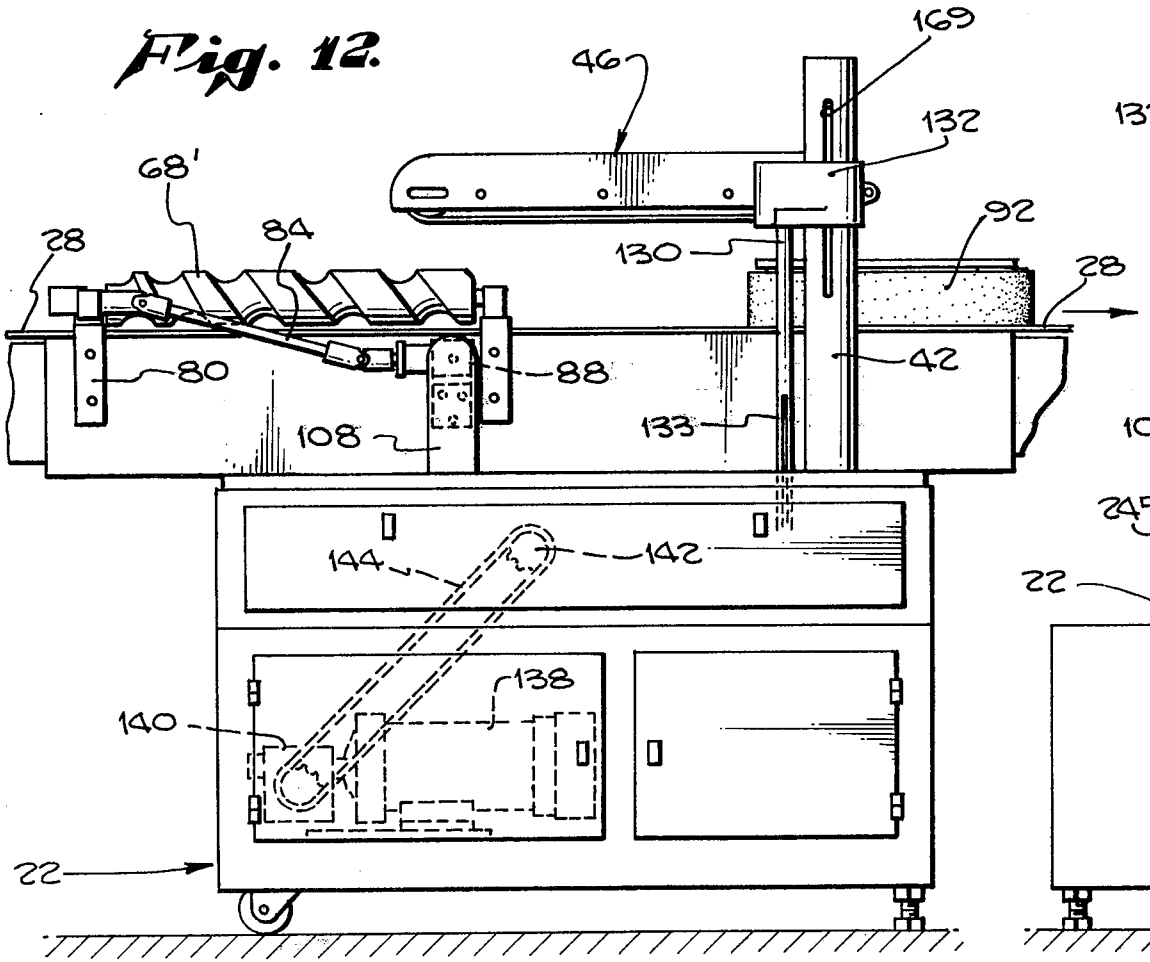
FIG. 12 is a diagrammatic showing indicating the relative positioning of the wrap belt, the hold-down belt, the feed screw drive, and the main motor of the universal apparatus.

FIGS. 12 and 13 are additional views of the universal machine showing the hold-down belt assembly 46 with its associated drive unit 132 as well as the associated power drive shaft 130. The vertical drive slot 133 in the lower portion of shaft 130 is also shown in FIG. 12. Also shown in FIGS. 12 and 13 is the wrap belt assembly 92. It may be noted that the drive unit and speed reducer 48 for the conveyor belt 28 is also shown in FIG. 13 and that, as in other figures, its showing overlaps that of the wrap belt assembly 92 which is located on the same side and near the same end of the universal system.

A ¾ horsepower variable speed motor 138 is shown mounted toward the bottom of the standard base or cabinet 22 in these figures of the drawings. Power from the drive motor 138 is supplied to the speed reducer 140, and output power from the speed reducer 140 is supplied to drive shaft 142 by the sprocket chain 144.

The mounting for one of the columns 36 is shown in some detail in the end view of FIG. 13. Initially, the ¾ inch aluminum plate 146 is bolted onto the step surface 148 of the cabinet 22. As previously mentioned the universal base 22 is made of heavy gauge steel, approximately ⅛ inch thick. Accordingly, the support plate 146 may be directly bolted to the upper surface 148 of the stepped base 22 and will be firmly and securely supported in this position. Fixedly secured to the mounting plate 146 is the column base 150. The column 36 is mounted on an upper support member 152, and this is in turn held by "T-bolts" to the member 154 which is slidably mounted on the intermediate structure 156. Ways 158, similar to those found on a lathe or other machine tools provides longitudinal adjustment of the column 36 relative to the machine base 22. An additional set of ways 160 provides transverse adjustment for the column 36 toward and away from the conveyor belt 28. The movement on the ways 158 and 160 is under the control of hand operated feed screws, (not shown) which provide fine manual adjustment.

FIGS. 14 and 15 are partial cross-sectional views of the assembly 132 which drives and supports either the powered top roller 122, or the hold-down belt assembly 46. FIG. 14 is a top view of the unit 132, and FIG. 15 is a partial cross-sectional view taken along lines XV—XV of FIG. 14. In FIG. 14 the opening 164 receives a vertical supporting column, such as Column 42 as shown in FIGS. 12 and 13, for example. The clamp 166 serves to secure the opening 164 to the column. The dog point screw 168 has a close fit in the vertical slot 169, to hold the unit against radial misalignment. Lock nut 170 holds screw 168 in place. The clamp 166 is released prior to vertical adjustment of the assembly 132 in the manner mentioned above. The keyed or slotted shaft 130 (see FIG. 12) drives the bevel gear 172 and they both have their central axes at point 174. The mating bevel gear 176 drives the shaft 178 to which the roller 122 or the hold-down belt is secured. Incidentally, the roller 122 is provided with an outer resilient surface 180, and a retaining screw 182 for engaging the threaded hole 184; and a dowel pin 186 is mounted in shaft 178 for driving engagment with the transverse slot 188 in one end of the roller assembly 122.

In showing of FIG. 15, the drive shaft 130 extends to drive the bevel gears 172 and the mating bevel gear 176 which drives the shaft 178.

Figure 16:
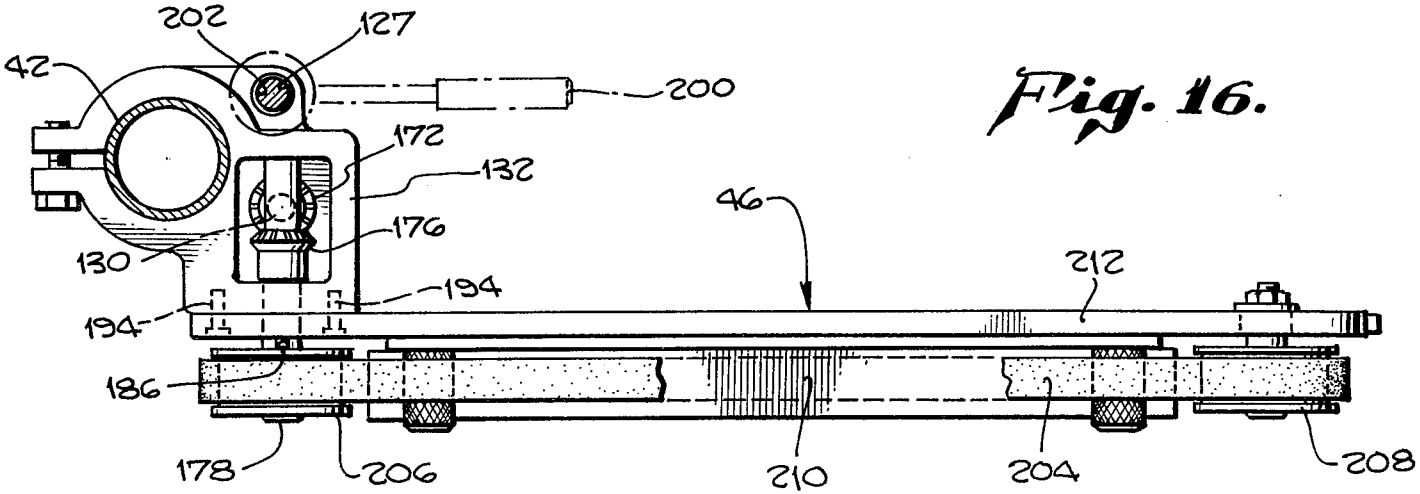
FIGS. 16 and 17 are top and side views, respectively, showing the assembly of FIG. 14 with the hold-down belt assembly mounted on it.
Figure 17:
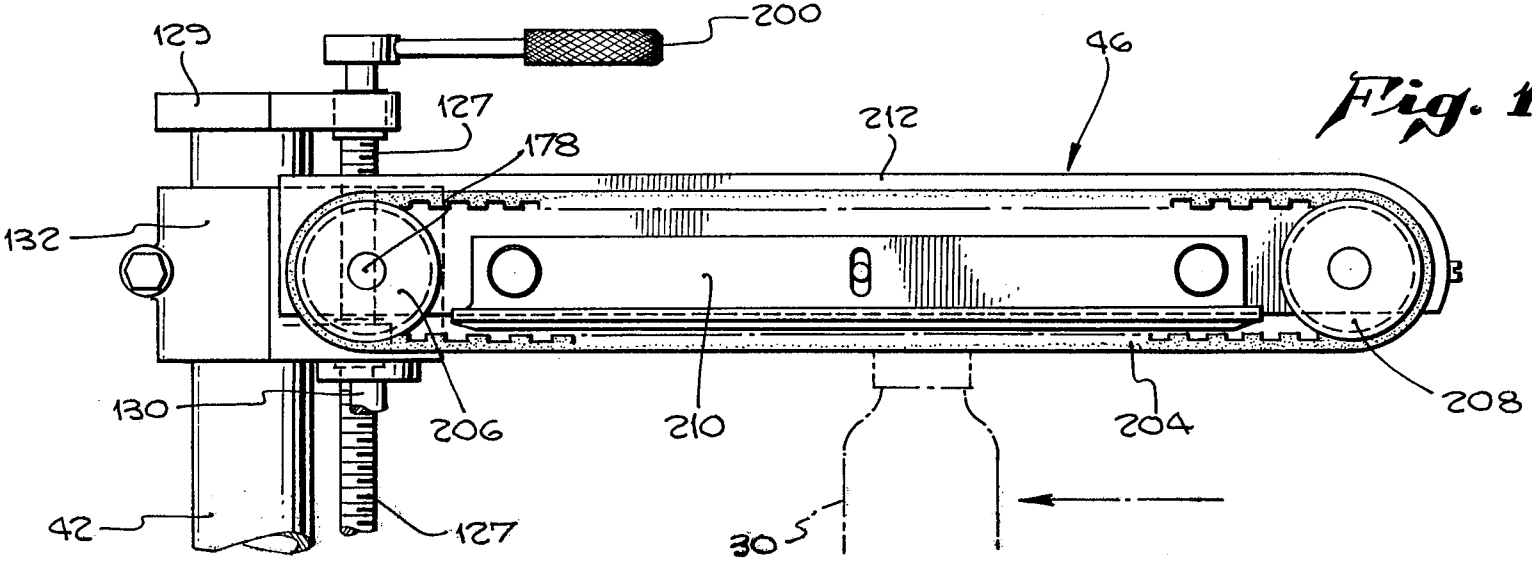

FIGS. 16 and 17 show the hold-down belt assembly 46 in somewhat greater detail than it appears in other figures of the drawings. As mentioned above, the hold-down belt assembly 46 is designed for securing to the drive unit 132 interchangeably with the powered roller 122. More particularly, note that the surface 192 of the unit 132 is provided with threaded holes through which the fasteners 194 secure the hold-down belt assembly 46. Supplementing the previous showing, in FIG. 17 the bracket 129 is shown providing a support for the rotatable threaded shaft 127, which may be turned by rotation of the handle 200. The threaded shaft 127 makes threaded engagement with the drive and support assembly 132 through the threaded opening 202, thereby permitting the raising and lowering of the drive unit 132 as the handle 200 is rotated.

The flexible hold-down belt 204 is supported at each end on the rollers 206 and 208, and is provided with a back-up support 210 to prevent undue flexing of the belt 204 between the two rollers. An additional longitudinal support and protective cover 212 is also provided. The belt 204 is preferably provided with inner lugs corresponding to matching lugs on drive 206, to insure the proper surface speed of the belt 204, matching that of the conveyor belt.

Incidentally, the vertical extent of the hold-down belt 204 around the drive roller 206 is equal to the diameter of the powered roller 122 of FIG. 14. As previously mentioned, it is desired that the surface speed both of the roller 122 and also of the belt 204, be equal to that of the conveyor 28. With these speeds being equal, there is no tendency to tip the product as the label is being applied. Further, with the two diameters being equal, there is no need to change the drive speed of the shaft 178 when shifting from the powered roller to a hold-down belt type of label application.

Figure 18:
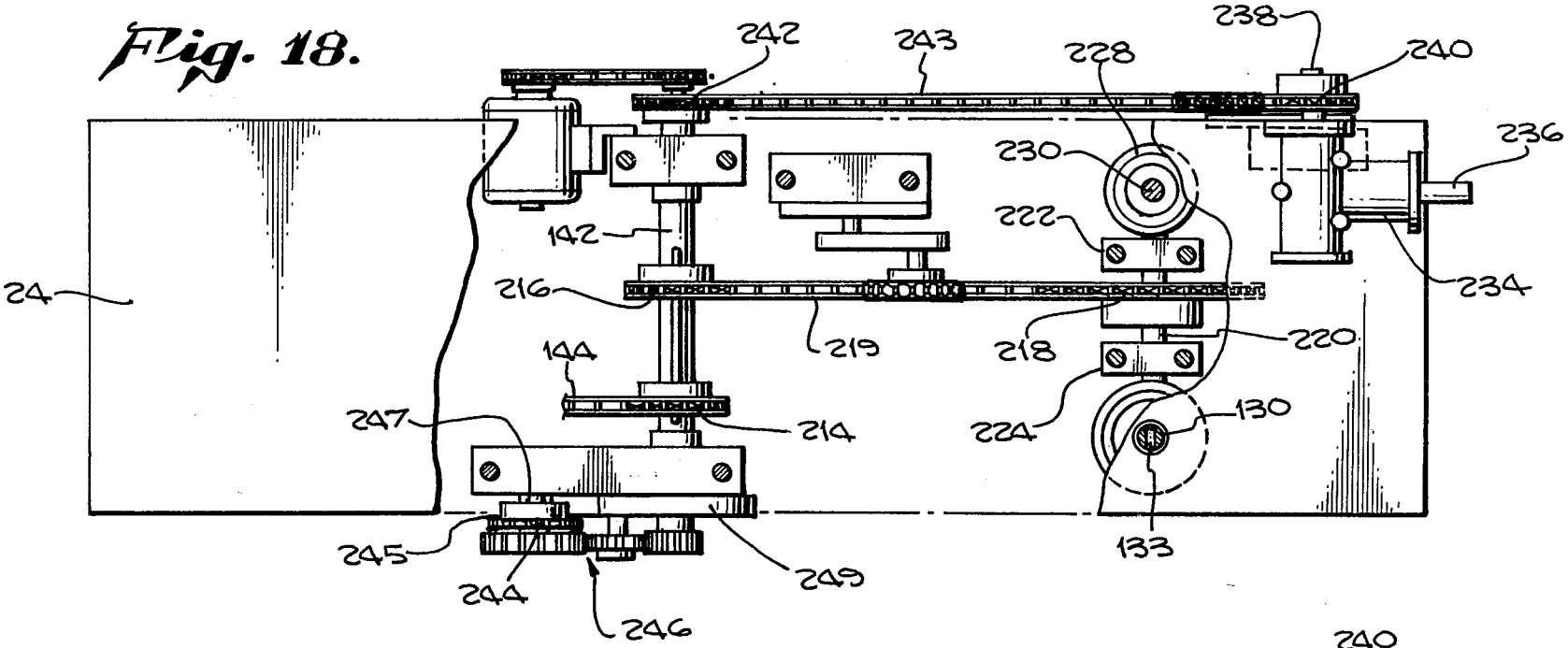
FIGS. 18 and 19 show the power drive arrangements for the universal labeling machine.
Figure 19:
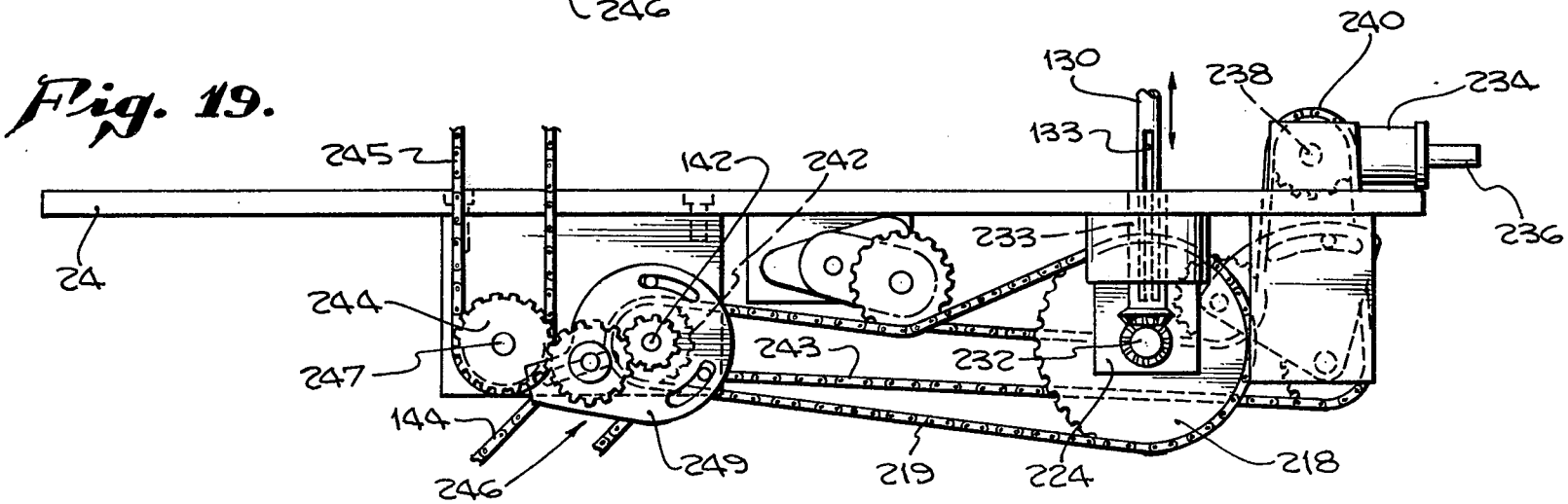

FIGS. 18 and 19 are showings of the power drive arrangements for the universal label application machine of the present invention. It may be recalled from FIG. 12 that the mechanical power for the universal machine was supplied from the main drive motor 138 to the speed reducer 140 and coupled by the chain 144 to the shaft 142. In FIG. 18 the sprocket 214 is coupled directly to the speed reducer 140 as shown in FIG. 12, and supplies the driving force for the principal power take-off points of the universal machine through the mechanical coupling arrangements shown in FIGS. 18 and 19.

More particularly, mechanical power from the shaft 142 is coupled by the sprockets 216 and 218, interconnected by the sprocket chain 219, to drive the additional power shaft 220 which is located to the right of and parallel to the shaft 142. The shaft 220 is mounted by bearings located in the support members 222 and 224 which are secured to the heavy ¾ inch thick aluminum plate 24 as shown in FIG. 19. Bevel gears 228 drive a shaft 230 by which the wrap belt is driven through a short universal coupling, when a wrap belt is employed.

An additional set of bevel gears 232 are located at the opposite end of the shaft 220, with the bevel gear having a vertically oriented axis having a keyed opening extending through an attached sleeve 233 to permit the passage of the slotted shaft 130 (see FIG. 12), so that the powered upper roller or the hold-down belt may be vertically adjusted without any significant mechanical changes being required in the overall unit.

As mentioned previously, the conveyor belt speed reducer is located on the outer side of the support for the conveyor belt and is driven by a universal shaft. The power take-off point for this shaft is shown at 234 at the upper right-hand portion of FIG. 19. The output take-off shaft is designated by the reference numeral 236. The input shaft 238 is driven by the sprocket 240 which is coupled to the sprocket 242 by a sprocket chain 243. Sprocket 242 is keyed to the power input shaft 142 previously mentioned.

The feed screws for picking up products and advancing them to conveyor speed are driven from a sprocket wheel 244 with the chain 245 extending from sprocket wheel 244 up to drive the power transmission unit 106 (see FIGS. 3 and 7) being protected by the shield 108, as also shown in FIGS. 3 and 7. The sprocket wheel 244 is driven through the quick change gear assembly 246. This quick change gear assembly is of standard configuration and permits relatively easy alteration of the relative speed of rotation of the shaft 142 and the sprocket wheel 244. This is accomplished by changing the gears mounted on shafts 142 and 247. For example by changing the gear mounted on shaft 142 from 25 teeth to 20 teeth, the product pitch is increased to five inches from four inches. Mounting plate 249 permits both radial and circumferential shifting of idler shaft about drive shaft 142 to readily accomodate gear changes to change product pitch. This permits easy changing of the pitch of the products supplied by the feed screws, which is particularly useful for small products when the four inch pitch is not as efficient as would be desirable. By changing and specifically increasing the rate of rotation of the sprocket wheel 244, and providing a feed screw or a pair of feed screws with a lower pitch, or more turns per linear inch along the conveyor, small products will be spaced more closely together, and will still be moving at the same speed as the conveyor belt at the time they are labelled. Alternatively, and as in the gear change example noted above, the rate of rotation of the feed screw drive may be reduced to accomodate larger products. In each case when the feed screw rate of rotation is changed relative to the conveyor speed, a new feed screw, or pair of feed screws is required.

Incidentally, although the drive arrangements for the two feed screws are not shown in FIGS. 18 and 19, the power transmitted from the sprocket 244 through the sprocket chain 245 within the shield 108 to the power transmission unit 88 (see FIGS. 3 and 7) is also transmitted through the support 26 for the conveyor 28 to the paired power transmission unit 90 on the other side of the conveyor to drive a corresponding feed screw, when such a second feed screw is employed. When the second feed screw is not employed, then the drive shaft 86, as shown in FIG. 3, is of course not provided. The power take-off unit 90 may still be included in the applicator as sold, so that the customer is given the capability of using dual feed screws if an appropriate occasion should arise at a future date.

Figure 20:
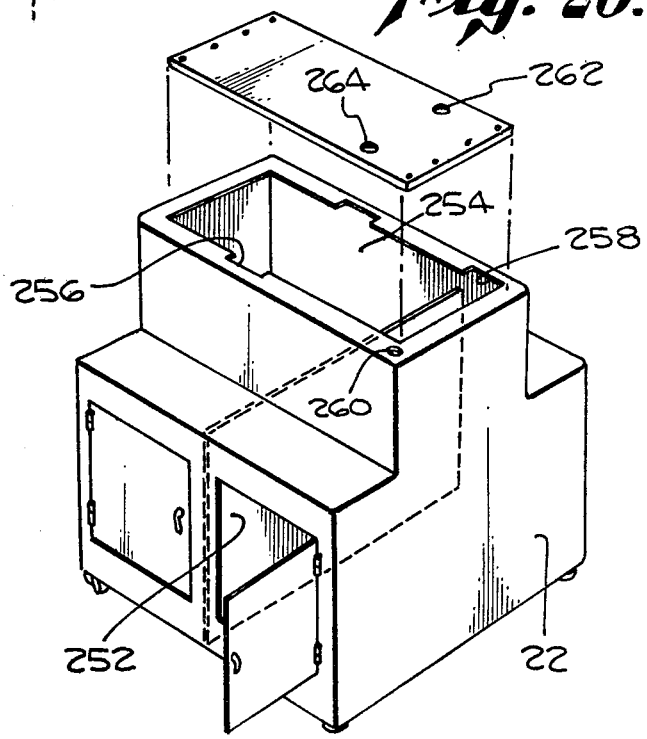
FIG. 20 shows the cabinet and central deck plate employed in all of the applicator systems shown in the present drawings.

To emphasize the standardized nature of the present universal labeling maching, FIG. 20 shows the standard base including the heavy sheet metal cabinet 22 and deck plate 24, which are used in each universal machine. The cabinet 22 is fabricated of 12 gauge sheet steel, and has a heavy central vertical reinforcing plate 252 which provides additional strength. The cabinet 22 has an upper opening 254 provided with a standard cut-out 256 for the feed screw chain drive, another standard cut-out 258 for the conveyor chain drive to the unit 234, and an opening 260 for electrical connections. Further the heavy duty central deck plate 24, which is made of a ¾ inch thick aluminum plate, is standardly fabricated with two substantial size bored holes 262 and 264 to accommodate the drive shafts for the wrap belt, and the power unit for the top roller or hold down belt. And the foregoing access openings and clearance cutouts are formed in each cabinet and deck plate, whether or not they will be needed for the particular initial labeling application requested by the customer.

Now that the principal features of the present universal machine have been delineated, it is again pointed out that the present universal machine as described in terms of the illustrative embodiment, has provided a standardized power system with arrangements for driving (1) the conveyer, (2) a left-hand feed screw for one side of the conveyer, (3) a right-hand feed screw for the other side of the conveyer (4) a wrap-around belt, and (5) a top power unit which may be either a powered roller or a hold-down belt. All of the power take-off points are connected and "stubbed in" with suitable access through the cabinet or base and the deck plate, so that if a user of the equipment wishes to perform a different labeling application, it is a simple matter to purchase an additional minor piece of equipment, attach it to the existing power take-off point, and proceed with the new labeling application. A collateral advantage is the manufacture of bases in large quantities, as special differing types of bases need not be made to order; instead a single universal base is employed for all applications. Similarly, differently designed mechanical power systems are not required. Instead, a single master power unit is employed for every application. Further, because of the standardization, the drive units are less expensive, despite their greater capability than those which had previously been employed.

It is again noted that many of the components are interchangeable, or are applicable to more than one function. Thus, either the top powered roller or the hold-down belt may be secured to the same drive. Further, this top power drive may be raised and lowered in its position without the need for any change in equipment, in order to accommodate labeling applications in which the product to be labelled is of varying heights. It is further noted that, for applications where the feed screw is to be oriented in one direction from the power take-off point, interchangeability is provided with the unit which normally extends in the opposite direction on the other side of the conveyor; with the resulting advantage of increased flexibility without significant additional cost to the user.

The virtually universal external adjustability of the present apparatus, starting with a standardized base and standardized mechanical power supply, up to the power take-off points, is another important feature of the invention. Thus, by the use of variable length external drive shafts 84, 86 (FIG. 3), and 95 (FIG. 9), for example; adjustable brackets such as the slotted bracket 97 permitting vertical and lateral positioning of the wrap belt; and other adjustable components for positioning the applicator heads or the hold-down belt; full versatility in accomplishing nearly all labeling applications is achieved notwithstanding the standardization within the base unit.

In closing, it is to be understood that the above-described embodiment is merely illustrative of the principles of the invention. Thus, by way of example, and not of limitation, minor modifications in the arrangements would include the use of alternative standard mechanical power transmission arrangements, a base of a somewhat different exterior configuration, and other interchangeable mechanical drive parts. Accordingly, the present invention is not to be limited to the specific preferred embodiment shown in the drawings.

What is claimed is:

1. A universal labeling system comprising:

a standard base having a cross-section of inverted "T-shaped" configuration; said base including a heavy gauge sheet metal cabinet having a central longitudinally extending raised portion and a heavy metal deck plate mounted on said raised portion;

conveyor belt means for carrying containers to be labeled from an input end to an output end of said conveyor belt means, mounted on said deck plate;

means for applying labels to products moving along said conveyor belt means;

standard mechanical drive system means within said base for providing power to power take-off points for each of the following: (a) said conveyor belt means; (b) a feed screw on one side of the conveyor belt means, (c) a feed screw on the other side of the conveyor belt means, (d) a wrap belt, and (e) top power means for moving an upper product engaging means at the same surface speed as the conveyor belt means and above and spaced from the conveyor belt means;

a hold down belt assembly;

means for selectively connecting said hold-down belt assembly to said top power take-off point to stabilize tall products for label application;

a pair of matched product feed screws;

means for selectively connecting said pair of feed screws to said two power take-off points on one side and on the other side of said conveyor belt means, respectively, and at the input end of said conveyor belt means; and for driving said feed screws to accelerate products to be labeled onto said conveyor belt means at the speed of said conveyor belt means;

a wrap belt assembly;

means for selectively connecting said wrap belt assembly to said wrap belt power take-off point to rotate a generally circular product and secure a label to its outer surface;

a single feed screw;

means for selectively mounting said single feed screw near the center of said conveyor belt means and for driving said feed screw from the downstream end of said feed screw from one of said two feed screw power take-off points;

a top powered roller; and means for selectively mounting said top powered roller to said top power take-off point to apply labels to the top of products; and said standard base being provided with openings, through its heavy duty cabinet or deck plate and associated with each of said power take-off points, to accommodate the transmission of mechanical power from within said base to each of the external associated equipment to be driven.

2. A univeral labeling system as defined in claim 1 wherein said base is provided with stepped mounting ledges on each side, and means are provided for adjustably mounting a plurality of label applicator means from said mounting ledges.

3. A universal labeling system as defined in claim 1 wherein the diameter of said top powered roller is substantially equal to the vertical extent of said hold down belt where power is supplied to said hold down belt whereby the surface speed of the selected roller or belt is equal to that of the conveyor.

4. A universal labeling system as defined in claim 1 wherein the means for driving said single screw on one side of said conveyor belt means from the output end of said conveyor belt means is interchangeable with the means for driving one of said pair of feed screws on the other side of said conveyor belt means at the input end of said conveyor belt means.

5. A universal labeling system as defined in claim 1 comprising quick change gear assembly means for supplying mechanical power to said feed screw take-off points, whereby the pitch of the products may be readily varied on said conveyor belt means to more efficiently handle both large and small products.

6. A universal labeling system as defined in claim 1 further comprising shaft means mounted external to said base for driving said conveyor belt means.

7. A universal labeling system as defined in claim 1 wherein means are provided for vertically adjusting said top power means to accommodate products of different height, and substantially vertical shaft power transmission means are provided for permitting vertical adjustment of said top power means without other mechanical adjustments.

8. A universal labeling system as defined in claim 7 wherein said vertical shaft is provided with a longitudinal groove engaging a keyed opening in the power take-off point assembly, to provide power transmission with different positions of said shaft and keyed opening.

9. A universal labeling machine comprising:

an inverted generally "T-shaped" base having a central longitudinally extending raised portion, said base including a cabinet having a heavy gauge outer casing;

conveyor belt means for carrying containers to labeled along the top of the raised portion of said base;

an external speed reducer and drive for said conveyor belt means located at one end of said conveyor;

feed screw means for moving containers to be labeled onto said conveyor belt means;

means for mounting standard applicator units to apply labels to any or all of the exposed surfaces of said containers;

a plurality of standardized power take-off connection means located on said base; said power take-off means including: means for driving the conveyor through said external speed reducer, means for driving either a hold-down belt or a powered roller, means located on one side of the base for driving a first feed screw, means located on the other side of the base for driving a second feed screw, and means for driving a wrap belt;

said heavy gauge outer casing being provided with openings associated with each of said power take-off means to accommodate associated power transmission equipment; and means for connecting at least one of said feed screw power take-off means to drive said feed screw means.

10. A universal labeling machine as defined in claim 9 further comprising a hold-down belt, and means for connecting said hold-down belt to one of said power take-off means.

11. A universal labeling machine as defined in claim 9 further comprising a wrap belt, and means for connecting said wrap belt to one of said power take-off means.

12. A universal labeling machine as defined in claim 9 further comprising a powered top roller, and means for connecting said powered top roller to one of said power take-off means.

13. A universal labeling machine comprising:

an inverted generally "T-shaped" integral cabinet having a central longitudinally extending raised portion;

conveyor belt means for carrying containers to be labeled along the top of the raised portion of said base;

feed screw means for moving containers to be labeled from a storage area onto said conveyor belt means;

means for mounting standard applicator units to apply labels to any or all of the exposed surfaces of said containers;

means for providing mechanical power to a plurality of standardized power take-off points; and means for selectively coupling different alternative labeling system powered equipment to said power take-off points to apply labels to different types of products.

14. A universal labeling apparatus comprising:

a standard heavy duty base including a fabricated cabinet having an integral heavy gauge sheet steel exterior;

a conveyor belt mounted on said base;

standard mechanical drive system means for providing power to power take-off points for (a) said conveyor belt, (b) a feed screw on one side of the conveyor belt (c) a feed screw on the other side of the conveyor (d) a wrap belt and (e) top powered means for moving an upper product engaging means at the same surface speed as the conveyor and above and spaced from the conveyor;

means for dispensing labels to be secured to products moving along said belt;

means for mechanically connecting some but not all of the following equipment to said power take-off points: (1) a feed screw located on one side of said conveyor near the input end of said conveyor (2) a feed screw located on the other side of said conveyor near the input end of said conveyor, (3) a feed screw for wrap-around applications located toward the center of the said conveyor belt; (4) a wrap belt, (5) a top roller, and (6) a top hold-down belt; to perform one label application function; and means for connecting a different set of some but not all of said equipments (1) through (6) to said power take-off points to perform a different label application function.

15. A universal labeling apparatus comprising:

a standard base with a heavy duty exterior;

conveyor belt means for moving products along the length of said base;

standard mechanical drive system means within said base for providing power to power take-off points for each of the following: (a) said conveyor belt means (b) a feed screw on one side of the conveyor, (c) a feed screw on the other side of the conveyor, (d) a wrap belt, and (e) powered means moving at the same surface speed as the conveyor and above and spaced from the conveyor;

means for dispensing labels to be secured to products moving along said belt;

means for mechanically connecting some but not all of the following equipments to said power take-off points: (1) a feed screw located on one side of said conveyor belt means near the input end of said conveyor belt means (2) a feed screw located on the other side of said conveyor belt means near the input end of said conveyor belt means; (3) a feed screw for wrap around applications located toward the center of the said conveyor belt means; (4) a wrap belt, (5) a top roller and (6) a top hold-down belt; to perform one label application function;

means for mechanically connecting a different set of some but not all of said equipments (1) through (6) to said power take-off points to perform a different label application function; and said standard base being provided with openings through its heavy duty exterior, associated with each of said power take-off points, to accommodate the transmission of mechanical power from within said base to all of the external associated equipments to be driven.

16. A universal labeling apparatus comprising:

a standard heavy duty base with a heavy gauge exterior casing, and having an inverted "T-shaped" cross-sectional configuration;

conveyor means mounted on the central raised portion of said base;

standard mechanical drive system means mounted within said base, said standard drive system means including: (a) power take-off means for driving said conveyor belt means; (b) power take-off means for driving a feed screw from one side of the conveyor means; (c) power take-off means for driving a feed screw from the other side of the conveyor means; (d) power take-off means for driving a wrap belt and (e) power take-off means for driving either a powered top roller or a powered hold-down belt, both of which are to be operated at the same surface speed as the conveyor means, and above and spaced from the conveyor means;

means for dispensing labels to be secured to products moving along said belt;

means for mounting the following equipments on said base: (1) a feed screw located on one side of the said conveyor means near the input end of said conveyor means, (2) a feed screw located on the other side of said conveyor means, near the input end of said conveyor means; (3) a feed screw for wrap-around applications located toward the center of the said conveyor belt means; (4) a wrap belt, (5) a top roller and (6) a top hold-down belt;

means for connecting some but not all of equipments (1) through (6) to said power take-off points, to perform one label application function;

means for connecting a different set of some but not all of said equipments (1) through (6) to said power take-off means to perform a different application function; and said heavy gauge exterior casing having openings to permit the transmission of power from said standard mechanical drive system means to each of said equipments (1) through (6) through said power take-off means.

17. A universal labeling machine comprising:

an inverted generally "T-shaped" base having a central longitudinally extending raised portion;

conveyor belt means for carrying containers to be labeled along the top of the raised portion of said base;

feed screw means for moving containers to be labeled from a storage area onto said conveyor belt means;

means for mounting standard applicator units to apply labels to any or all of the exposed surfaces of said containers;

a plurality of standardized power take-off points located in said base;

first means for performing a first labeling system function in synchronism with the speed of said conveyor belt and employing a first member engaging the product in a first location with respect to said base, second means for performing a second different labeling system function in synchronism with the speed of said conveyor and employing a second member engaging said product in a second location with respect to said base; and means utilizing common equipment for providing driving power, from one of said standardized power take-off points selectively to said first or said second means for supplying driving power to said first and second means.

18. A system as defined in claim 17 wherein said first means for performing a first labeling system function is a hold-down belt, and said second means for performing a second labeling function is a powered applicator roller.

19. A system as defined in claim 18 wherein said powered applicator roller has a diameter equal to the spacing between the upper and lower surfaces of said hold-down belt; and further comprising means for supplying driving power to said one of said power take-off points so that the surface speed of said belt or said roller remains equal to the surface speed of said conveyor belt means.

20. A system as defined in claim 17 wherein said first means for performing a first labeling system function constitutes product feed screw means located in a predetermined location along the length of said conveyor belt means in one direction from an associated power take-off point in said base, and wherein said second means is another product feed screw located at a different location along the length of said conveyor belt means in the other direction from said power take-off point.

21. A universal labeling system comprising:

a standard base;

conveyor belt means for carrying containers to be labeled from an input end to an output end of said system, mounted on said base plate;

means for applying labels to products moving along said conveyor belt means;

standard mechanical drive system means within said base for providing power to power take-off points for each of the following: (a) said conveyor belt means; (b) a feed screw on one side of the conveyor belt means, (c) a feed screw on the other side of the conveyor belt means, (d) a wrap belt, and (e) top power means for moving an upper product engaging means at the same surface speed as the surface speed of said conveyor belt means and above and spaced from the conveyor belt means;

a hold-down belt assembly;

means for selectively connecting said hold-down belt assembly to said top power take-off point to stabilize tall products for label application;

a pair of matched product feed screws;

means for selectively connecting said pair of feed screws to said two power take-off points on one side and on the other side of said conveyor belt means respectively, and at the input end of said conveyor belt means; and for driving said feed screws to accelerate products to be labeled onto said conveyor belt means at the speed of said conveyor belt means;

a wrap belt assembly;

means for selectively connecting said wrap belt assembly to said wrap belt power take-off point to rotate a generally circular product and secure a label to its outer surface;

a single feed screw;

means for selectively mounting said single feed screw near the center of said conveyor belt means and for driving said feed screw from the output end of said feed screw from one of said two feed screw power take-off points;

a top powered roller; and means for selectively mounting said top powered roller to said top power take-off point to apply labels to the top of products; and said standard base being provided with openings through its heavy duty cabinet or deck plate and associated with each of said power take-off points, to accommodate the transmission of mechanical power from within said base to each of the external associated equipment to be driven.

22. A universal labeling system as defined in claim 1 wherein the diameter of said top powered roller is substantially equal to the vertical extent of said hold-down belt where power is supplied to said hold-down belt whereby the surface speed of the selected roller or belt is equal to that of the conveyor belt means.

23. A universal labeling machine comprising:

a standard base;

conveyor belt means for carrying containers to be labeled along the top of said base;

feed screw means for accelerating containers to be labeled onto said conveyor belt means;

means for mounting standard applicator units to apply labels to any or all of the exposed surfaces of said containers;

a plurality of standardized power take-off points located in said base;

first means for performing a first labeling system function in synchromism with the speed of said conveyor belt means and employing a first member engaging the product in a first location with respect to said base, second means for performing a second different labeling system function in synchronism with the speed of said conveyor belt means and employing a second member engaging said product in a second location with respect to said base; and means utilizing common equipment for providing driving power, from one of said standardized power take-off points selectively to said first means or to said second means for supplying driving power to said first means or to said second means.

24. A system as defined in claim 23 wherein said first means for performing a first labeling system function is a hold-down belt, and said second means for performing a second labeling function is a powered label applicator roller.

25. A system as defined in claim 24 wherein said powered applicator roller has a diameter equal to the spacing between the upper and lower surfaces of said hold-down belt; and further comprising means for supplying driving power to said one of said power take-off points so that the surface speed of said belt or said roller remains equal to the surface speed of said conveyor belt means.

26. A system as defined in claim 23 wherein said first means for performing a first labeling system function constitutes product feed screw means located in a predetermined location along the length of said conveyor belt means in one direction from an associated power take-off point in said base, and wherein said second means is another product feed screw located at a different location along the length of said conveyor belt means in the other direction from said power take-off point.

27. A versatile and fully adjustable labeling machine for accomplishing all of the standard labeling applications including (1) top labeling, (2) single side labeling, (3) front and back labeling, and (4) wrap labeling, through the use of a standard base and mechanical power supply system mounted within the base and fully adjustable and variable associated equipment outside of the base, comprising:

a standard prefabricated base including a heavy gauge sheet metal cabinet;

a standard power supply providing standard power take-off means at or near the surface of said base for (1) the conveyor drive, (2) feed screw drives for both sides of the conveyor, (3) top power drive for a roller or a hold-down belt, and (4) a wrap belt drive;

a conveyor belt of desired length and having an external drive connection near one end thereof;

drive shaft means external to said base of the required length for interconnecting said conveyor belt with said conveyor power take-off means;

vertically adjustable means for providing a resilient surface above and spaced from said conveyor belt and moving at the speed of said conveyor belt to apply downward pressure on products being labeled;

a wrap belt;

means for adjustably mounting said wrap belt for the selective application of labels to round products;

feed screw means for accelerating products to be labeled onto said conveyor at the speed of said conveyor; and means external to said base for selectively mounting and driving said feed screw means at a desired location.

* * * * *